US011299965B2

(12) United States Patent
Fripp et al.

(10) Patent No.: US 11,299,965 B2
(45) Date of Patent: Apr. 12, 2022

(54) COMPLETION SYSTEMS AND METHODS TO COMPLETE A WELL

(71) Applicant: Halliburton Energy Services, Inc., Houston, TX (US)

(72) Inventors: Michael Linley Fripp, Carrollton, TX (US); Zachary William Walton, Edmond, OK (US); John Todd Broome, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/003,841

(22) Filed: Aug. 26, 2020

(65) Prior Publication Data

US 2021/0172297 A1 Jun. 10, 2021

Related U.S. Application Data

(60) Provisional application No. 62/946,217, filed on Dec. 10, 2019.

(51) Int. Cl.
*E21B 43/08* (2006.01)
*E21B 34/14* (2006.01)

(52) U.S. Cl.
CPC ..... *E21B 43/084* (2013.01); *E21B 34/14* (2013.01); *E21B 2200/06* (2020.05)

(58) Field of Classification Search
CPC ..... E21B 43/084; E21B 34/14; E21B 2200/06
See application file for complete search history.

(56) References Cited

U.S. PATENT DOCUMENTS 3,314,481 A * 4/1967 Willman ..... E21B 43/082 166/205
6,510,896 B2 1/2003 Bode et al.
7,387,165 B2 6/2008 Lopez De Cardenas et al.
7,571,765 B2 8/2009 Themig
8,191,627 B2 6/2012 Hamid et al.
8,479,808 B2 7/2013 Gouthaman
(Continued)

FOREIGN PATENT DOCUMENTS

WO 2003046335 A1 6/2003

OTHER PUBLICATIONS

International Search Report and Written Opinion issued in corresponding International PCT Patent Application No. PCT/US2020/048285.

*Primary Examiner* — Dany E Akakpo
(74) *Attorney, Agent, or Firm* — McGuireWoods LLP

(57) ABSTRACT

Completion systems and methods to complete a well are disclosed. A method to complete a well includes installing a casing across a plurality of zones of a well. The casing includes an opening and a sleeve positioned inside the casing. The method also includes shifting the sleeve from a first position to a second position to uncover the opening to provide fluid communication from a zone of the plurality of zones to the casing. After shifting the sleeve from the first position to the second position, the method includes flowing a screen assembly having a filter inside the casing and toward the sleeve. The method further includes positioning the filter around the opening and sealing the screen assembly around the opening to confine fluid flow through the opening to flow through the filter.

20 Claims, 5 Drawing Sheets

(56) References Cited

U.S. PATENT DOCUMENTS

2006/0124310 A1* 6/2006 Lopez de Cardenas ..... E21B 43/14 166/313
2014/0051612 A1* 2/2014 Mazyar ..... E21B 33/1208 507/269

* cited by examiner

COMPLETION SYSTEMS AND METHODS TO COMPLETE A WELL

The present disclosure relates generally to completion systems and methods to complete a well.

Completion systems are sometimes deployed during completion operations of a hydrocarbon well. Completion systems sometimes include screens that are deployed along a casing to prevent certain particles from flowing into the casing during hydrocarbon production.

BRIEF DESCRIPTION OF THE DRAWINGS

Illustrative embodiments of the present disclosure are described in detail below with reference to the attached drawing figures, which are incorporated by reference herein, and wherein.

Figure 1:
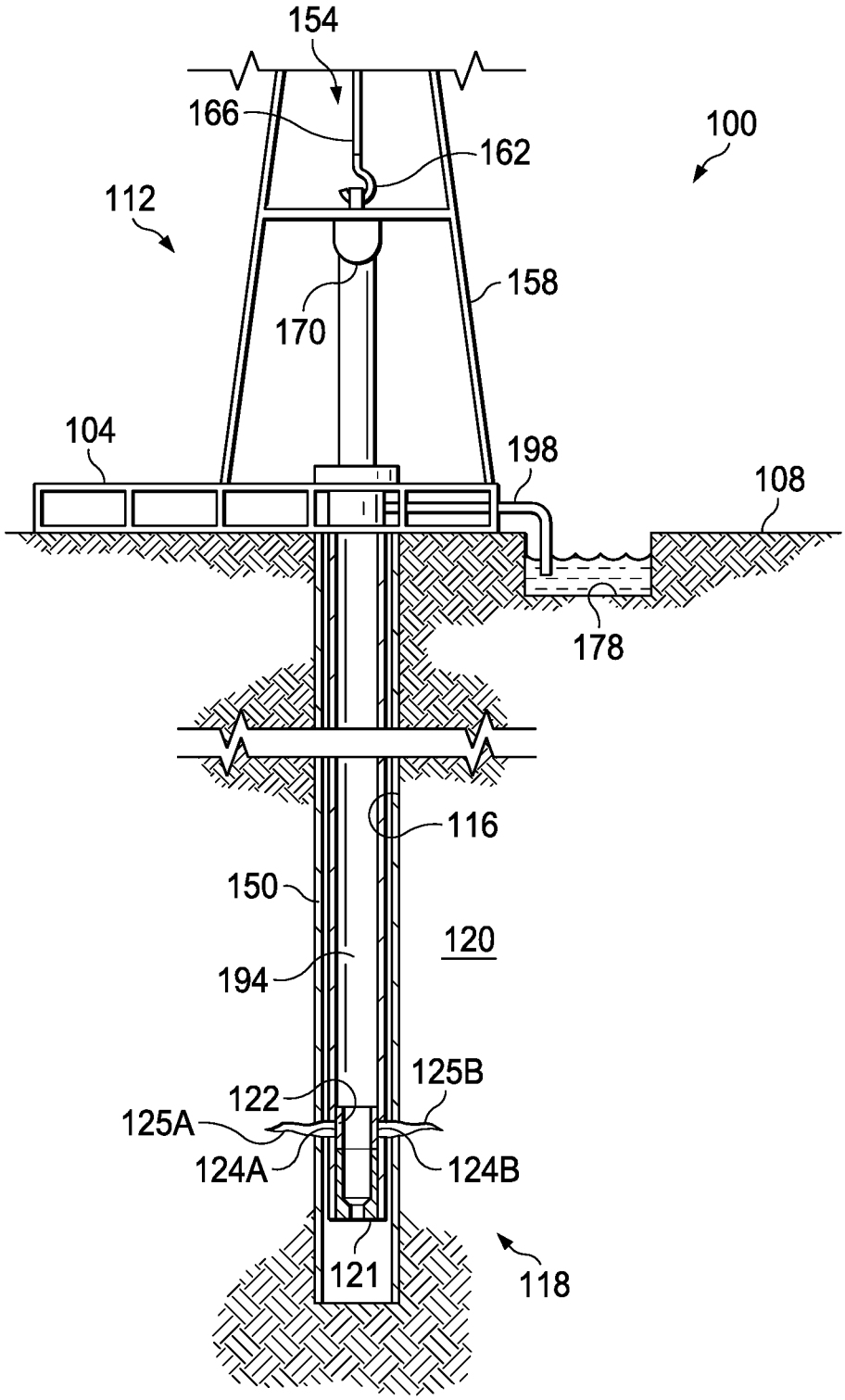
FIG. 1 is a schematic, side view of a completion environment in which a completion system is deployed in a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to completion systems and methods to complete a well. A casing is installed across multiple zones of a wellbore of a hydrocarbon well. As referred to herein, a casing includes oilfield tubulars, production tubing, or any other type of conveyance that has an inner diameter that provides a passageway for solids and fluids to travel downhole. The casing also has one or more openings (e.g., production holes) that provide fluid passageways from the surrounding formation into the casing. In some embodiments, the openings are formed during a perforation operation. In some embodiments, the openings are formed before the casing is installed downhole. A sleeve is deployed in each zone of the casing. In some embodiments, the sleeves are each configured to shift from a first position that covers one or more openings to a second position that uncovers the one or more openings. In some embodiments, a diverter (e.g., a ball) is dropped into the passageway, where the ball flows downhole until the ball is caught by baffles of the sleeve disposed in the bottom zone (first sleeve). A force generated by the ball landing on the baffles of the first sleeve shifts the first sleeve from a first position to a second position to expose one or more openings previously covered by the first sleeve. In some embodiments, the baffle is electrically deployed after the casing has been installed in the wellbore. In some embodiments, a completion operation, such as a hydraulic fracturing operation is performed through the one or more openings to create or enhance fractures through the formation at or near the one or more openings.

A screen assembly having a filter configured to filter out materials greater than a threshold size and one or more seals configured to seal off an area around the filter is deployed in the casing.

As referred to herein, a filter is any device, structure, material, or component that prevents materials greater than a threshold size from flowing through the filter. Examples of filters include, but are not limited to, surface filters such as wire wrap screen assemblies or woven meshes, depth filters like metal wools, and layered fibers. In some embodiments, filters are porous structures such as bonded-together proppants. In some embodiments, filters are formed from wires wrapped around a pipe with a gap between the wires, a metal mesh protected by a perforated covering, or a combination of layers of wire wrap, mesh and protective layers.

The screen assembly also has a lateral surface that is degradable, or is configured or engineered to burst, puncture, or break in response to a threshold amount of pressure applied to the surface. In some embodiments, the lateral surface of the screen assembly is a burst disc, a rupture disc, a burst diaphragm, or another surface configured or engineered to burst, rupture, puncture, or break when a threshold amount of pressure (e.g., 1,000 psi, 5,000 psi, or another number of psi) is applied to the surface. In one or more of such embodiments, pressure less than the threshold amount is applied to the lateral surface to initially deploy the screen assembly downhole toward the sleeve. After deployment of the screen assembly to a location proximate to the sleeve, pressure greater than or equal to the threshold amount of pressure is applied to burst, rupture, puncture, or break the surface, thereby providing fluid communication through the screen assembly. In some embodiments, where the diverter is a dissolvable ball that has dissolved prior to landing on the screen assembly, the screen assembly also lands on the baffles of the first sleeve. In some embodiments, where the diverter remains intact or partially intact, the screen assembly lands on the diverter. In some embodiments, the screen assembly includes a pipe that is positioned adjacent to the one or more openings with the filter positioned above or below the pipe.

In some embodiments, the screen assembly lands at a position where the filter of the screen assembly is positioned around or near the one or more openings in the zone that the screen assembly landed in. In one or more of such embodiments, the screen assembly is positioned adjacent the one or more openings in the zone. In one or more of such embodiments, the screen assembly is positioned above the one or more openings. In one or more of such embodiments, the screen assembly is positioned below the one or more openings. In one or more of such embodiments, the screen assembly is positioned opposite the one or more openings. In one or more of such embodiments, the seals of the screen assembly are configured to fluidly seal off an area between the screen assembly and the casing such that fluids flowing through the one or more openings flow through the filter into the casing. In some embodiments, the sealing is performed with one or more frac plugs. In some embodiments, a sealing element, such as a swellable polymer or an expanding metal is utilized to fluidly seal off an area between the screen assembly and the casing. Additional descriptions of the screen assembly and components of the screen assembly are provided in the paragraphs below and are illustrated in at least FIGS. 1-5.

In some embodiments, after deployment of the seals of the screen assembly, a second diverter (e.g., a ball) is deposited into the casing and lands on an adjacent sleeve (second sleeve) that is disposed in a zone adjacent to and further uphole from the first diverter sleeve. The force of the ball landing on the second sleeve shifts the second sleeve from a first position that initially covers one or more openings to a second position that uncovers the one or more openings. In some embodiments, a hydraulic fracturing operation is performed to create or enhance fractures through the one or more openings, and a second screen assembly is deposited on or near the second sleeve to filter fluids flowing through one or more openings in the zone of the second sleeve. In some embodiments, where the casing extends through multiple zones, the foregoing operations are repeated until a screen assembly is deployed and installed in each zone.

Turning now to the figures, FIG. 1 is a schematic, side view of a completion environment 100 where a completion system 118 having a casing 150, a sleeve 121 and a screen assembly 122 is deployed in a wellbore 116 of a well 112. As referred to herein, a casing may be a coiled tubing, a drill pipe, an oilfield tubular, a production tubing, or another type of conveyance that has an inner diameter that forms a flowbore for fluids and solid particles and components (e.g., diverters) to pass through. In some embodiments, casing 150 is a tubular (such as production tubing) and is disposed inside a wellbore casing that forms a semi-permanent or permanent barrier between wellbore 116 and casing 150. In some embodiments, casing 150 is a production tubing or another type of conveyance that is deployable in an open-hole configuration during a well operation, and is retrievable from wellbore 116 after completion of the well operation. In some embodiments, casing 150 is a wellbore casing that is semi-permanently or permanently installed in wellbore 116.

In one or more of such embodiments, a cement sheath (not shown) formed from cement slush is deposited in an annulus between casing 150 and wellbore 116 to fixedly secure the casing 150 to wellbore 116 and to form a barrier that isolates the casing 150.

After drilling of wellbore 116 is complete and the associated drill bit and drill string are "tripped" from wellbore 116, casing 150 is lowered into wellbore 116. In the embodiment of FIG. 1, casing 150 is lowered by a lift assembly 154 associated with a derrick 158 positioned on or adjacent to rig 104 as shown in FIG. 1. Lift assembly 154 includes a hook 162, a cable 166, a traveling block (not shown), and a hoist (not shown) that cooperatively work together to lift or lower a swivel 170 that is coupled to an upper end of casing 150. In some embodiments, casing 150 is raised or lowered as needed to add additional sections to casing 150 and to run casing 150 across a desired number of zones of wellbore 116.

In the embodiment of FIG. 1, casing 150 includes a flowbore 194 through which a diverter (such as a ball) travels through downhole. As referred to herein, downhole refers to a direction along casing 150 that is away from the surface end of casing 150, whereas uphole refers to a direction along casing 150 that is towards the surface end of casing 150. In some embodiments, casing 150 provides a fluid flow path for fluids to flow into one or more cross-over ports (not shown) that provide fluid flow around (such as up and/or below) sleeve 121, where the fluid eventually flows uphole into an outlet conduit 198, and from outlet conduit 198 into a container 178. In one or more of such embodiments, hydraulic pressure is exerted through a cross-over port to shift sleeve 121 (such as to shift sleeve 121 uphole), apply a threshold amount of pressure to a lateral surface of a screen assembly, reverse out a diverter from sleeve 121, and/or to perform other well operations. In some embodiments, one or more pumps (not shown) are utilized to facilitate fluid flow downhole or uphole, and to generate pressure downhole or uphole.

In the embodiment of FIG. 1, sleeve 121 has been shifted downhole, and screen assembly 122 has been positioned to cover openings 124A and 124B. Additional descriptions of shifting sleeves, such as sleeve 121, and positioning screen assemblies, such as screen assembly 122, are provided herein and are illustrated in at least FIGS. 2A-2C. Screen assembly 122 has a filter that filters particles flowing from fractures 125A and 125B of formation 120 through openings 124A and 124B. Screen assembly 122 also has a sealing element that seals screen assembly 122 around openings 124A and 124B to direct fluid flow through openings 124A and 124B to flow through the filter of screen assembly 122.

Although FIG. 1 illustrates a substantially vertical wellbore 116, the completion system described herein is deployable in horizontal wellbores, diagonal wellbores, tortuous shaped wellbores, and other types of wellbores. Further, although FIG. 1 illustrates one sleeve 121 and one screen assembly 122 disposed along flowbore 194 of casing 150, in some embodiments, multiple sleeves and multiple screen assemblies (shown in FIGS. 2A-2C) are disposed in flowbore 194 of casing 150 across multiple zones of wellbore 116. Further, although FIG. 1 illustrates a completion system deployed in a completion environment, sleeve 121 and screen assembly 122 are also deployable in other well environments. Similarly, operations described herein to shift sleeve 121, flow screen assembly 122 proximate to an opening, and position a filter of screen assembly 122 proximate the opening may be performed during stimulation operations, production operations, as well as other types of well operations. Additional descriptions of different embodiments of a completion system are illustrated in FIGS. 2-5.

Figure 2C:
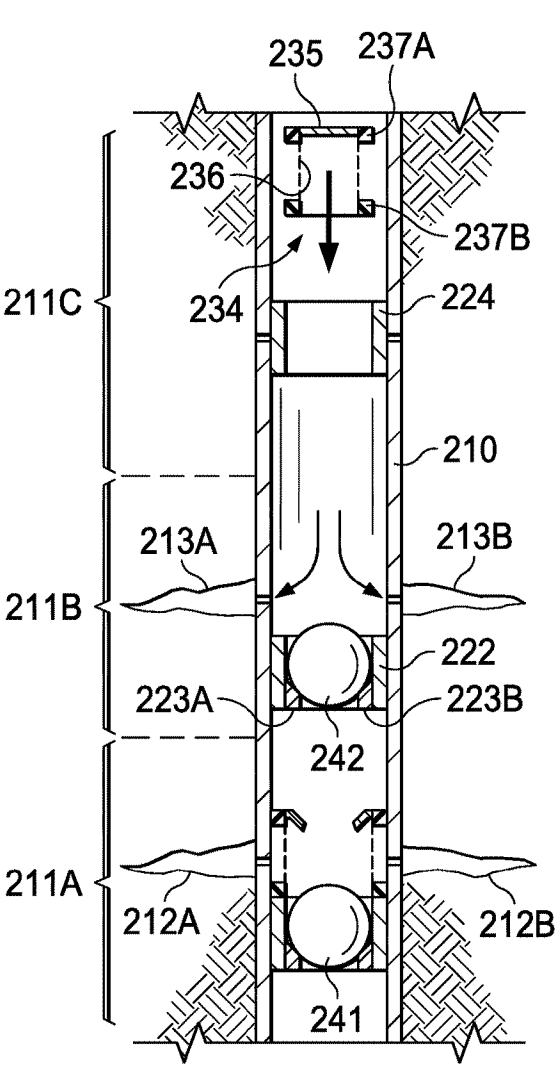
FIGS. 2A-2C illustrate a process to complete a well.
Figure 2B:
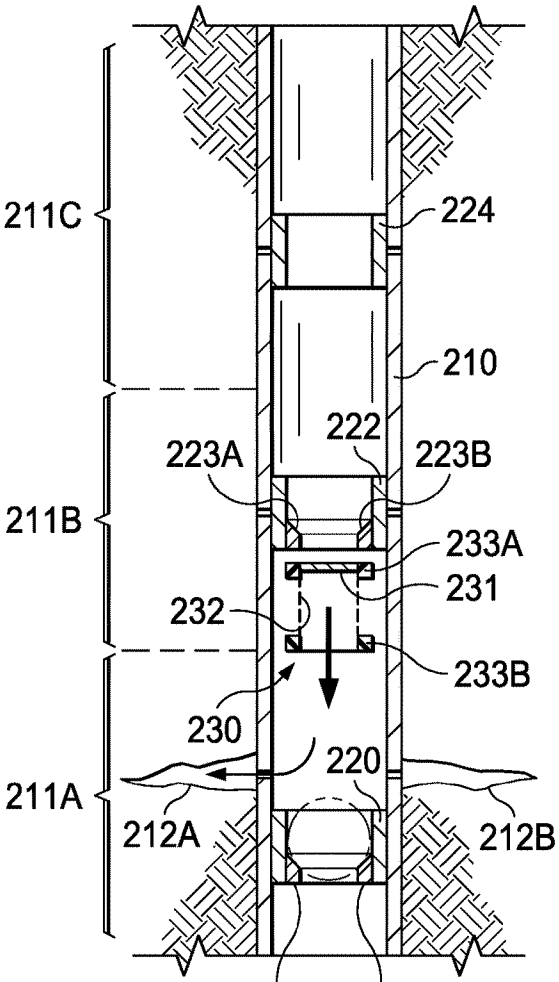
Figure 2A:
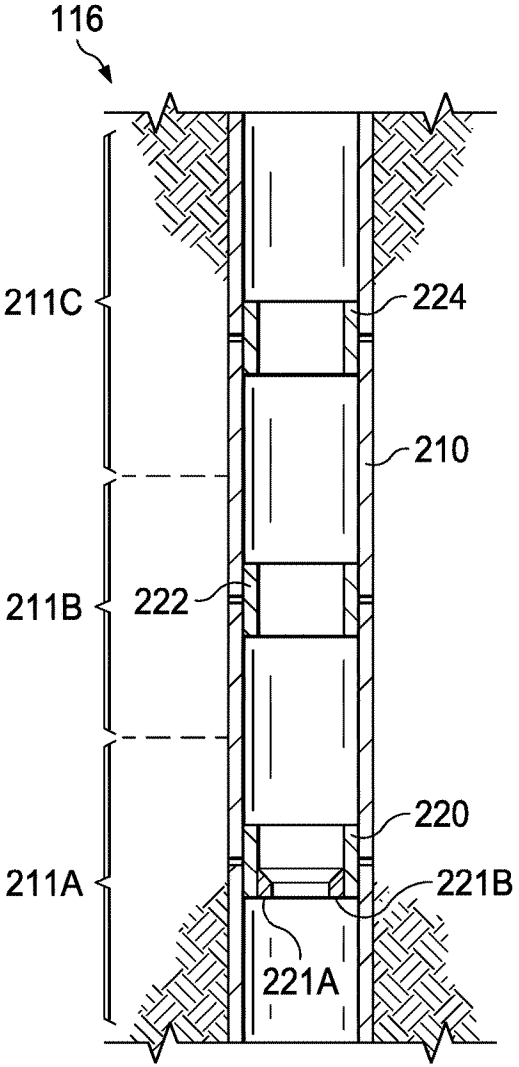

FIG. 2A is a schematic, cross-sectional view of a casing 210 installed across three zones 211A-211C of a wellbore 116 of FIG. 1. Further, sleeves 220, 222, and 224 are coupled to the interior of casing 210. Each of sleeves 220, 222, and 224 is initially in a first position that covers one or more openings (shown in FIG. 2C) of casing 210. Further, each of sleeves 220, 222, and 224 is shiftable from the first position to a second position to uncover one or more openings previously covered by the respective sleeve. In some embodiments, each of sleeves 220, 222, and 224 also includes baffles or other components, which when activated, allows the respective sleeve to catch solid objects flowing through casing 210. In some embodiments, the activation occurs by counting the number of previous zones that have been stimulated. In the embodiment of FIG. 2A, sleeve 220 includes baffles 221A and 221B, which have been activated to catch solid objects flowing through casing 210. In some embodiments, baffles 221A and 221B are activated after a threshold period of time. In some embodiments, baffles 221A and 221B are activated electrically, mechanically, or hydraulically.

After baffles 221A and 221B are activated, a diverter, such as a ball, is dropped in casing 210, where the ball flows downhole until the ball lands on baffles 221A and 221B. A force generated by the ball shifts sleeve 220 from a first position illustrated in FIG. 2A to a second position illustrated in FIG. 2B to uncover one or more openings previously covered by sleeve 220 while sleeve was in the first position as shown in FIG. 2A. In some embodiments, one or more completion operations are performed through the uncovered openings. In the embodiment of FIGS. 2A-2C, a fracturing operation is performed through the openings that were uncovered by sleeve 220 to create and enhance fractures, such as fractures 212A and 212B (as shown in FIG. 2B) in the surrounding formation.

A screen assembly is then deployed in casing 210. In that regard, FIG. 2B illustrates deploying a screen assembly 230 in casing 210 and flowing screen assembly 230 downhole towards sleeve 220. In the embodiment of FIG. 2B, screen assembly 230 includes a lateral surface 231 that is configured to or engineered to break in response to a threshold amount of pressure applied to lateral surface 231. In some embodiments, lateral surface 231 is a burst disc, a rupture disc, or another type of component that is configured to or engineered to break in response to a threshold amount of pressure applied to lateral surface. In some embodiments, lateral surface 231 is formed from a metal, ceramic, glass, or polymer. In some embodiments, lateral surface 231 is a degradable material such as an aluminum alloy, magnesium alloy, aliphatic polyester, or a urethane. In some embodiments, lateral surface 231 is a dissolvable material. In some embodiments, lateral surface 231 is a meltable material that is configured to melt at downhole temperatures. In one or more of such embodiments, where lateral surface is configured or engineered to break in response to a threshold amount of pressure applied to lateral surface 231, an amount of pressure that is less than the threshold amount of pressure is applied to lateral surface 231 to aid downhole deployment of screen assembly 230. In one or more embodiments, the lateral surface 231 is not configured to break and is only configured to dissolve or degrade in the wellbore fluids. In one or more of such cases where a lateral surface is configured to dissolve, degrade, or melt (instead of breaking), the lateral surface is positioned on downhole side proximate seal 233B rather than proximate seal 233A as shown in FIG. 2B. Additional descriptions of seals 233A and 233B are provided herein.

In the embodiment of FIG. 2B, screen assembly 230 passing through sleeve 222 activates baffles 223A and 223B of sleeve 222. In some embodiments, screen assembly 230 includes a magnet that activates baffles 223A and 223B after screen assembly 230 passes through sleeve 222. In some embodiments, screen assembly 230 and sleeve 222 include RFID tags that identify passing of screen assembly 230 through sleeve 222. In some embodiments, screen assembly 230 and/or sleeve 222 include counters, such as RFID tags, acoustic signals, magnetic signals, or diameter profiles that determine whether screen assembly 230 has passed through sleeve 222 and whether to activate baffles 223A and 223B.

Screen assembly 230 also has a filter 232 that is configured to prevent solid particulates having a threshold size from flowing through filter 232. Further, screen assembly 230 also has seals 233A and 233B that are configured to fluidly seal screen assembly 230 around one or more openings, such as the openings uncovered by shifting of sleeve 220. Screen assembly 230 eventually lands on baffles 221A and 221B of sleeve 220, or on a diverter such as ball 241 of FIG. 2C. After screen assembly 230 lands on or near baffles 221A and 221B, filter 232 is positioned around the openings uncovered by sleeve 220 and seals 233A and 233B are actuated to seal screen assembly 230 and to confine fluid flow through the openings uncovered by sleeve 220 through filter 232. In one or more of such embodiments, seals 233A and 233B are swell polymers that are configured to form a fluid seal around filter 232, thereby restricting fluids and particles flowing through openings in zone 211A (as shown in FIG. 2A) to first flow through filter 232. In one or more of such embodiments, seals 233A and 233B are formed from an expanding metal that expands to form a fluid seal around filter 232, thereby restricting fluids and particles flowing through openings in zone 211A (as shown in FIG. 2A) to first flow through filter 232. The above described process is then performed in zone 211B.

In that regard, FIG. 2C illustrates flowing a ball 242 in casing 210. A force generated by landing of ball 242 or the hydraulic pressure acting against ball 242 on baffles 223A and 223B of sleeve 222 shifts sleeve 222 from a first position illustrated in FIG. 2B to a second position illustrated in FIG. 2C. As shown in FIG. 2C, the shifting of sleeve 222 to the position illustrated in FIG. 2C has uncovered openings previously covered by sleeve 222 while sleeve 222 was in a position illustrated in FIG. 2B. A completion operation, such as a fracturing operation, is then performed to create or to enhance fractures, such as fractures 213A and 213B in the surrounding formation. A second screen assembly 234, having a lateral surface 235, a filter 236, and seals 237A and 237B is then deployed in casing 210 to filter fluids flowing through the openings uncovered by shifting of sleeve 222. The foregoing process is repeated for each zone of zones 211A-211C. Although FIGS. 2A-2C illustrate three zones 211A-211C, in some embodiments, the foregoing process is performed for a different number of zones.

Figure 3A:
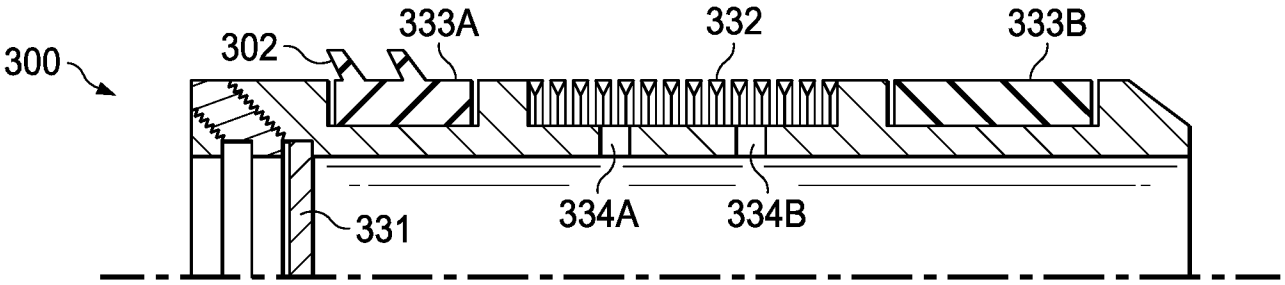
FIG. 3A illustrates a screen assembly deployable during the operation illustrated in FIGS. 2A-2C.
Figure 3B:
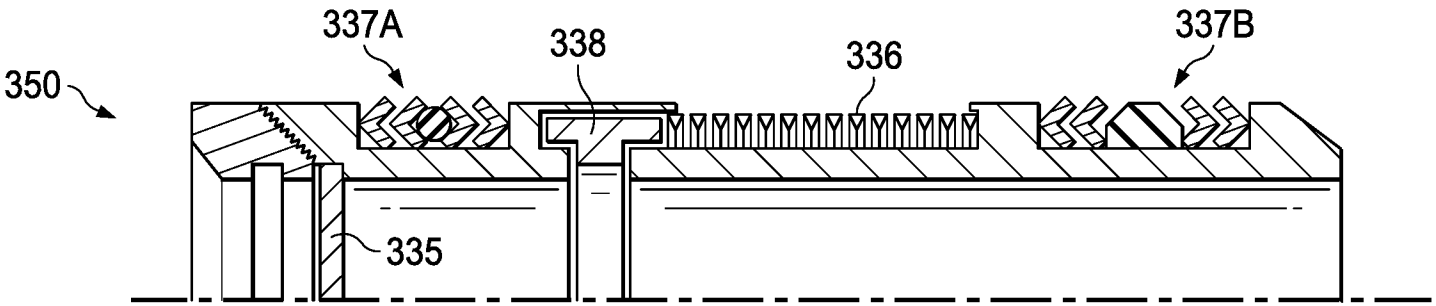
FIG. 3B illustrates another screen assembly deployable during the operation illustrated in FIGS. 2A-2C.

FIG. 3A illustrates a screen assembly 300 that is deployable during the operation illustrated in FIGS. 2A-2C. In the embodiment of FIG. 3A, screen assembly 300 includes a rupture disc 331, and a filter 332 configured to prevent solid particles greater than a threshold size from flowing through openings 334A and 334B, seals 333A and 333B. In some embodiments, screen assembly 300 also includes wiper 302 that is configured to improve the pump-down efficiency. FIG. 3B illustrates another screen assembly 350 deployable during the operation illustrated in FIGS. 2A-2C. In the embodiment of FIG. 3B, screen assembly 350 includes a rupture disc 335, a filter 336, and seals 337A and 337B. In some embodiments, filters 332 and 336 are surface filters, such as wire-wrap screen assemblies or meshes, or depth filters like metal wools. In some embodiments, filters 332 and 336 are porous structures like bonded-together proppants. In the embodiment of FIG. 3B, screen assembly 350 includes a flow restrictor 338 such as a nozzle, a tube, an inflow control device, an autonomous inflow control device, or an autonomous inflow control valve. In some embodiments, the flow restrictor 338 has a different restriction in one direction than in the other direction, such as a check valve or a fluidic diode. In some embodiments, screen assemblies 300 and 350 include other types of restrictors (e.g., inflow control devices, autonomous inflow control devices, check valves, etc.) that are configured to restrict or control flow of fluids that flow through filters 332 and 336, respectively. In some embodiments, screen assemblies 300 and 350 also include centralizers to reduce the likelihood of proppant interfering with the passage of screen assemblies 300 and 350, respectively. In one or more of such embodiments, the centralizer can be flexible. In one or more of some embodiments, the centralizer is fixed. In some embodiments, screen assemblies 300 and 350 also include anchoring mechanisms configured to prevent or reduce the likelihood of screen assemblies 300 and 350 from being produced out of the wellbore. In one or more of such embodiments, the anchoring mechanisms include latches such as from a collet, locking keys, or from a ratchet. In one or more of such embodiments, an anchor of the anchoring mechanisms arise from an expanding metal or from a swellable elastomer. In some embodiments, seals 333A, 333B, 337A, and 337B of FIGS. 3A and 3B are formed from an expanding metal, a swellable elastomer, a compressed elastomer, packing, or a seal stack, or other components that restrict or prevent movement of screen assemblies 300 and 350 and seal screen assemblies 300 and 350 around one or more openings to confine fluid flow through the openings to flow through filters 332 or 336, respectively.

In some embodiments, the interior of screen assemblies 300 and 350 contains a chemical to change the pH of the fluid. In one or more of such embodiments, an acid or acid precursor is used to enhance the dissolution of the frac plug or the frac ball, such as ball 242 of FIG. 2C. In one or more of such embodiments, anhydrous HCl or anhydrous citric acid is placed within the screen assembly area of screen assemblies 300 and 350 to facilitate with breaking the gel in the fracture as well as facilitating with dissolution of any dissolving components.

Figure 4A:
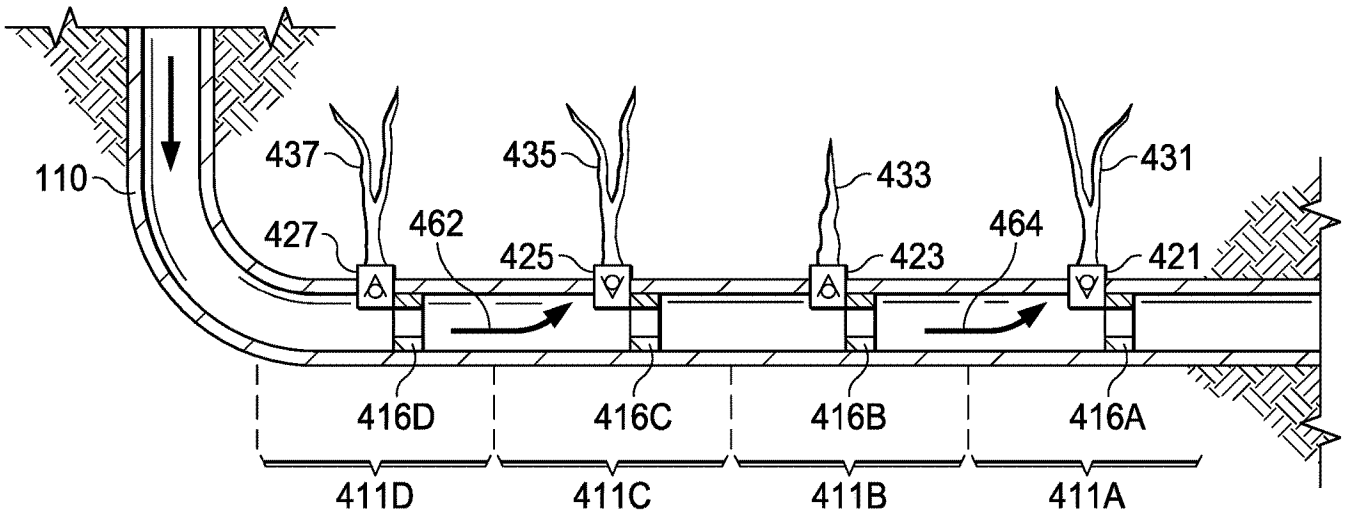
FIGS. 4A-4B illustrate another process to complete a well.
Figure 4B:
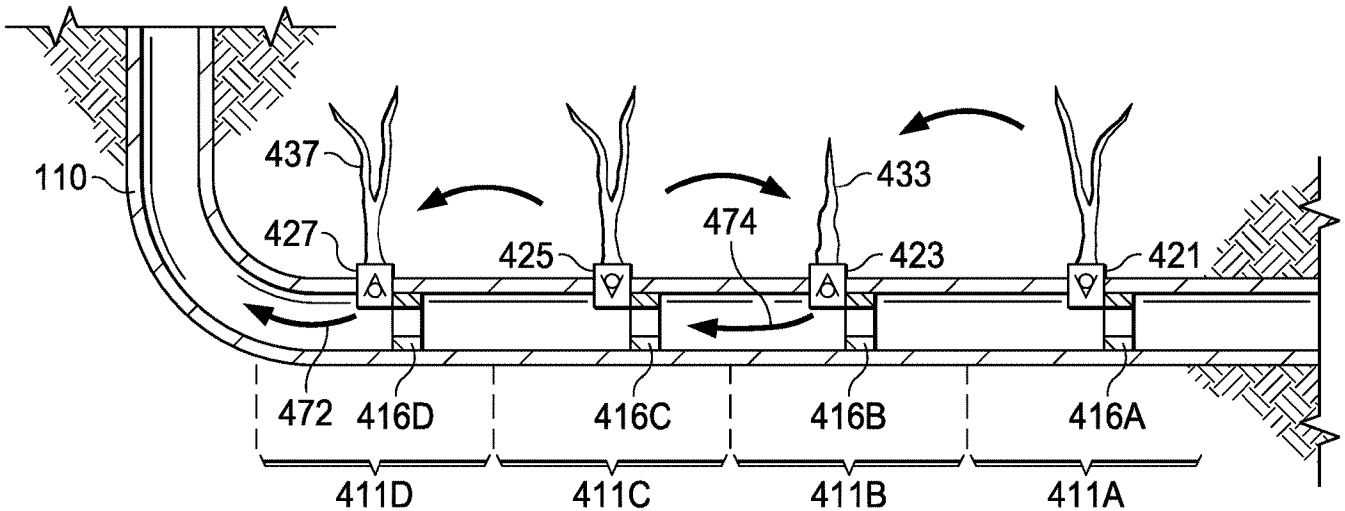

FIGS. 4A and 4B illustrate another process to complete a well. In the embodiment of FIGS. 4A and 4B, a casing 110 extends through zones 411A-411D. Further, sleeves 416A, 416B, 416C, and 416D are disposed in zones 411A-411D, respectively. More particularly, sleeves 416A and 416C, which are disposed in zone 411A and 411C contain or are coupled to restrictors 421 and 425 that permit fluid flow from casing 110 into fractures 431 and 435 of the formation at the respective zones, but reduce or prevent fluid flow in an opposite direction from the formation into casing 110. Examples of restrictors include, but are not limited to, check valves, such as ball checks, fluid vortexes, flappers, fluidic diodes, spring-loaded ball checks, diaphragm checks, duck-bill valves, reed valves, and other types of fluid restriction devices or components. Further, sleeves 416B and 416D, which are disposed in zones 411B and 411D contain or are coupled to restrictors 423 and 427 that permit fluid flow from fractures 433 and 437 of the formation at the respective zones into casing 110 but reduce or prohibit fluid flow in an opposite direction from casing 110 into the formation.

In the embodiment of FIG. 4A a fluid, such as an injection fluid that facilitates oil recovery, flows from casing 110 in directions illustrated by arrows 462 and 464 into fractures 431 and 435 of the formation in zones 411A and 411C, respectively. As stated herein, restrictors 421 and 425, permit fluid flow into fractures 431 and 435, but reduce or restrict fluid flow through restrictors 421 and 425 into casing 110. Over time, a desired amount of the fluid is pumped into zones 411A and 411C. In the embodiment of FIG. 4B, a fluid such as oil recovered as a result of an injection operation flows from the formation through fractures 433 and 437 at zones 411B and 411D, through restrictors 423 and 427, and into casing 110 in directions illustrated by arrows 474 and 472. In some embodiments, an enhanced oil recovery operation is performed in the environment illustrated in FIGS. 4A and 4B to inject fluid into some stages of the completion system and to periodically produce oil from other stages of the completion system (e.g., in zones 411B and 411D). In that regard, in the embodiments of FIGS. 4A and 4B, fluid injections are periodically performed at stages 411A and 411C through restrictors 421 and 425, which allow fluid flow from casing 110 into the formation, and oil is recovered through restrictors 423 and 427, which allow oil and other desired fluids to flow into casing 110.

Figure 5:
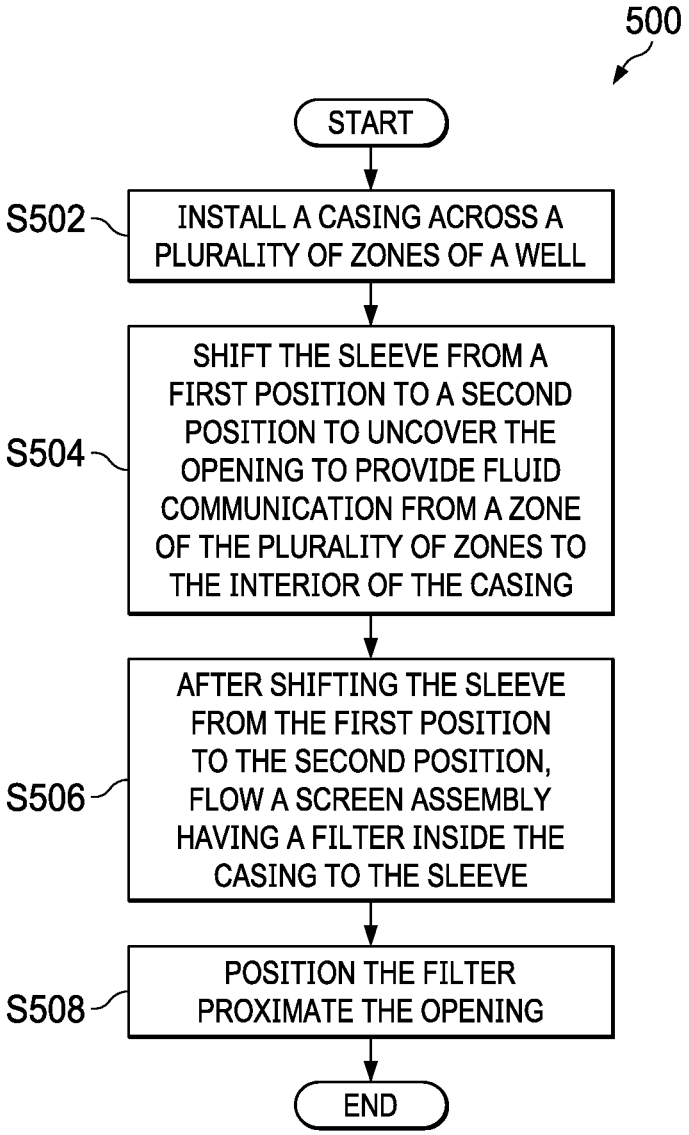
FIG. 5 is a flow chart of a process to complete a well.

FIG. 5 is a flow chart of a process 500 to complete a well. Although the operations in the process 500 are shown in a particular sequence, certain operations may be performed in different sequences or at the same time where feasible.

At block S502, a casing is installed across a plurality of zones of a well. The casing includes an opening and a sleeve positioned inside the casing. At block S504, the sleeve is shifted from a first position to a second position to uncover the opening to provide fluid communication from a zone of the plurality of zones to the interior of the casing. In some embodiments, force generated by a diverter such as a ball landing on the sleeve shifts the sleeve from the first position to the second position. In some embodiments, hydraulic pressure is applied to the diverter or directly to the sleeve to shift the sleeve from the first position to the second position. In some embodiments, a hydraulic fracturing operation is performed through the opening.

At block S506, after shifting the sleeve from the first position to the second position, a screen assembly having a filter flows inside the casing and toward the sleeve. In some embodiments, the screen assembly has a lateral surface that facilitates movement of the screen assembly inside the casing. In one or more of such embodiments, the lateral surface is configured to burst, rupture, or break in response to a threshold amount of force applied to the lateral surface. In that regard, an amount of force that is less than the threshold amount of force is applied to the lateral surface to facilitate deployment of the screen assembly. After the screen assembly is positioned at a desired location, a force greater than or equal to the threshold amount of force is applied to the lateral surface to burst, rupture, or break the lateral surface. In one or more of such embodiments, the lateral surface is configured to dissolve, degrade, or melt over a threshold period of time, or in response to coming in contact with another substance.

At block S508, the filter is positioned proximate the opening. In some embodiments, after the filter is positioned at a desired location proximate the opening, the screen assembly is fluidly sealed around the opening to confine fluid flow through the opening to flow through the filter. In some embodiments, where the multiple sleeves are positioned inside the casing, the operations described in blocks S504, S506, and S508 are repeated for each sleeve. For example, after performing the operation described in block S508, a second sleeve disposed inside the casing and in a second zone is shifted from a first position to a second position to uncover the second opening to provide fluid communication from the second zone to the casing. Further, after shifting the second sleeve from the first position to the second position, a second screen assembly having a second filter is disposed inside the casing to flow the second screen assembly toward the second sleeve. The second filter of the second screen assembly is then positioned around the second opening, and the second screen assembly is sealed around the second opening to confine fluid flow through the second opening to flow through the second filter.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a method to complete a well, the method comprising: installing a casing across a plurality of zones of a well, the casing comprising an opening and a sleeve positioned inside the casing; shifting the sleeve from a first position to a second position to uncover the opening to provide fluid communication from a zone of the plurality of zones to an interior of the casing; after shifting the sleeve from the first position to the second position, flowing a screen assembly having a filter inside the casing and toward the sleeve; and positioning the filter proximate the opening.

Clause 2, the method of clause 1, further comprising sealing the screen assembly around the opening to confine fluid flow through the opening to flow through the filter.

Clause 3, the method of clause 2, wherein the casing comprises a second opening and a second sleeve, the method further comprising: after sealing the screen assembly, shifting the second sleeve from a first position to a second position to uncover the second opening to provide fluid communication from a second zone of the plurality of zones to the casing; after shifting the second sleeve from the first position to the second position, flowing a second screen assembly having a second filter inside the casing and toward the second sleeve; positioning the second filter around the second opening; and sealing the second screen assembly around the second opening to confine fluid flow through the second opening to flow through the second filter.

Clause 4, the method of clause 3, wherein the casing comprises a third opening and a third sleeve, the method further comprising: after sealing the second screen assembly, shifting the third sleeve from a first position to a second position to uncover the third opening to provide fluid communication from a third zone of the plurality of zones to the casing; after shifting the third sleeve from the first position to the second position, flowing a third screen assembly having a third filter inside the casing and toward the third sleeve; positioning the third filter around the third opening; and sealing the third screen assembly around the third opening to confine fluid flow through the third opening to flow through the third filter.

Clause 5, the method of any of clauses 1-4, further comprising deploying a diverter into the casing, wherein a force generated by landing of the diverter on the sleeve shifts the sleeve from the first position to the second position.

Clause 6, the method of any of clauses 1-5, further comprising applying hydraulic pressure to the sleeve, wherein the hydraulic pressure applied to the sleeve shifts the sleeve from the first position to the second position.

Clause 7, the method of any of clauses 1-6, further comprising after shifting the sleeve from the first position to the second position, performing a hydraulic fracturing operation through the opening.

Clause 8, the method of any of clauses 1-7, wherein the screen assembly comprises a lateral surface configured to break in response to a threshold amount of pressure applied to the lateral surface, the method further comprising: applying a first amount of pressure to flow the screen assembly to the sleeve; and applying a second amount of pressure to break the lateral surface, wherein the first amount of pressure is less than the threshold amount of pressure and wherein the second amount of pressure is greater than or equal to the threshold amount of pressure.

Clause 9, a completion system, comprising: a casing that extends across a plurality of zones of a well, the casing comprising an opening that provides fluid communication from the well to the casing; a sleeve positioned inside the casing and configured to slide from a first position to a second position to uncover the opening; and a screen assembly comprising: a filter that is positioned proximate the opening; and a sealing element that seals the screen assembly around the opening to direct fluid flow through the opening to flow through the filter.

Clause 10, the completion system of clause 9, wherein the screen assembly is positioned around the opening to confine fluid flow through the opening to flow through the filter.

Clause 11, the completion system of clause 10, wherein the casing comprises a second opening, and wherein the completion system comprises a second sleeve positioned inside the casing and proximate to the second opening.

Clause 12, the completion system of clause 11, wherein the second sleeve is configured to shift from a first position to a second position to uncover the second opening to provide fluid communication from a second zone of the plurality of zones to the casing.

Clause 13, the completion system of clause 12, further comprising a second screen assembly having a second filter that is positioned proximate to the second sleeve, wherein the second screen assembly is sealed around the opening to confine fluid flow through the second opening to flow through the second filter.

Clause 14, the completion system of clause 13, wherein the casing comprises a third opening, and wherein the completion system comprises a third sleeve positioned inside the casing and proximate to the third opening.

Clause 15, the completion system of clause 14, wherein the third sleeve is configured to shift from a first position to a second position to uncover the third opening to provide fluid communication from a third zone of the plurality of zones to the casing.

Clause 16, the completion system of clause 15, further comprising a third screen assembly having a third filter that is positioned proximate to the third sleeve, wherein the third screen assembly is sealed around the third opening.

Clause 17, the system of any of clauses 9-16, wherein the screen assembly comprises a lateral surface configured to break in response to a threshold amount of pressure applied to the lateral surface.

Clause 18, the system of any of clauses 9-17, wherein the filter is configured to restrict flow of solid particles having a threshold size from flowing through the filter.

Clause 19, the system of any of clauses 9-18, wherein the sealing element is a swellable polymer.

Clause 20, the system of any of clauses 9-19, wherein the sealing element is an expanding metal.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A method to complete a well, the method comprising:

installing a casing across a plurality of zones of the well, the casing comprising an opening and a sleeve positioned inside the casing;

shifting the sleeve from a first position to a second position to uncover the opening to provide fluid communication from a zone of the plurality of zones to an interior of the casing;

after shifting the sleeve from the first position to the second position, flowing a screen assembly having a filter inside the casing and toward the sleeve; wherein the screen assembly comprises a lateral surface configured to break in response to a threshold amount of pressure applied to the lateral surface; wherein a first amount of pressure is applied to flow the screen assembly to the sleeve;

positioning the filter proximate the opening; and applying a second amount of pressure to break the lateral surface, wherein the first amount of pressure is less than the threshold amount of pressure and wherein the second amount of pressure is greater than or equal to the threshold amount of pressure.

2. The method of claim 1, further comprising sealing the screen assembly around the opening to confine fluid flow through the opening to flow through the filter.

3. The method of claim 2, wherein the casing comprises a second opening and a second sleeve, the method further comprising:

after sealing the screen assembly, shifting the second sleeve from a first position to a second position to uncover the second opening to provide fluid communication from a second zone of the plurality of zones to the casing;

after shifting the second sleeve from the first position to the second position, flowing a second screen assembly having a second filter inside the casing and toward the second sleeve;

positioning the second filter around the second opening; and sealing the second screen assembly around the second opening to confine fluid flow through the second opening to flow through the second filter.

4. The method of claim 3, wherein the casing comprises a third opening and a third sleeve, the method further comprising:

after sealing the second screen assembly, shifting the third sleeve from a first position to a second position to uncover the third opening to provide fluid communication from a third zone of the plurality of zones to the casing;

after shifting the third sleeve from the first position to the second position, flowing a third screen assembly having a third filter inside the casing and toward the third sleeve;

positioning the third filter around the third opening; and sealing the third screen assembly around the third opening to confine fluid flow through the third opening to flow through the third filter.

5. The method of claim 1, further comprising deploying a diverter into the casing, wherein a force generated by landing of the diverter on the sleeve shifts the sleeve from the first position to the second position.

6. The method of claim 1, further comprising applying hydraulic pressure to the sleeve, wherein the hydraulic pressure applied to the sleeve shifts the sleeve from the first position to the second position.

7. The method of claim 1, further comprising after shifting the sleeve from the first position to the second position, performing a hydraulic fracturing operation through the opening.

8. A completion system, comprising:

a casing that extends across a plurality of zones of a well, the casing comprising an opening that provides fluid communication from the well to the casing;

a sleeve positioned inside the casing and configured to slide from a first position to a second position to uncover the opening; and a screen assembly comprising:

a filter that is positioned proximate the opening;

a sealing element that seals the screen assembly around the opening to direct fluid flow through the opening to flow through the filter; and a lateral surface configured to break in response to a threshold amount of pressure applied to the lateral surface.

9. The completion system of claim 8, wherein the screen assembly is positioned around the opening to confine fluid flow through the opening to flow through the filter.

10. The completion system of claim 9, wherein the casing comprises a second opening, and wherein the completion system comprises a second sleeve positioned inside the casing and proximate to the second opening.

11. The completion system of claim 10, wherein the second sleeve is configured to shift from a first position to a second position to uncover the second opening to provide fluid communication from a second zone of the plurality of zones to the casing.

12. The completion system of claim 11, further comprising a second screen assembly having a second filter that is positioned proximate to the second sleeve, wherein the second screen assembly is sealed around the opening to confine fluid flow through the second opening to flow through the second filter.

13. The completion system of claim 12, wherein the casing comprises a third opening, and wherein the completion system comprises a third sleeve positioned inside the casing and proximate to the third opening.

14. The completion system of claim 13, wherein the third sleeve is configured to shift from a first position to a second position to uncover the third opening to provide fluid communication from a third zone of the plurality of zones to the casing.

15. The completion system of claim 14, further comprising a third screen assembly having a third filter that is positioned proximate to the third sleeve, wherein the third screen assembly is sealed around the third opening.

16. The completion system of claim 8, wherein the filter is configured to restrict flow of solid particles having a threshold size from flowing through the filter.

17. The completion system of claim 8, wherein the sealing element is a swellable polymer.

18. The completion system of claim 8, wherein the sealing element is an expanding metal.

19. The completion system of claim 8, further comprising a diverter; wherein a force generated by the landing of the diverter on the sleeve shifts the sleeve from the first position to the second position.

20. The completion system of claim 8, wherein the sleeve is configured to shift from the first position to the second position by the application of hydraulic pressure.

* * * * *